US012582216B1

(12) United States Patent
Kraft

(10) Patent No.: US 12,582,216 B1
(45) Date of Patent: Mar. 24, 2026

(54) CARRYING BAG FOR FEEDING PUMP

(71) Applicant: LAREE + CO., L.L.C., Fort Scott, KS (US)

(72) Inventor: Alivia Kraft, Fort Scott, KS (US)

(73) Assignee: LAREE + CO., L.L.C., Fort Scott, KS (US)

( * ) Notice: Subject to any disclaimer, the term of this patent is extended or adjusted under 35 U.S.C. 154(b) by 74 days.

(21) Appl. No.: 18/606,914

(22) Filed: Mar. 15, 2024

Related U.S. Application Data

(60) Provisional application No. 63/490,476, filed on Mar. 15, 2023.

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A45F 3/04
USPC ..... 224/191, 148.2
See application file for complete search history.

(56) References Cited

U.S. PATENT DOCUMENTS 5,687,840 A * 11/1997 Sherman ..... A45C 3/04 383/41
6,343,968 B1 * 2/2002 Louie ..... A47G 9/083 5/413 R
7,282,044 B2 * 10/2007 Hudson ..... A61J 15/00 604/174
9,260,285 B2 * 2/2016 Luebbers ..... A45C 11/20
D855,993 S 8/2019 Harris et al.
10,548,361 B1 * 2/2020 Suttman ..... A45F 3/04
D877,516 S 3/2020 Juras
10,813,845 B1 * 10/2020 Juras ..... A45F 3/04
D929,577 S 8/2021 Juras
(Continued)

FOREIGN PATENT DOCUMENTS

CN 104161677 A 11/2014

OTHER PUBLICATIONS

Abbott Laboratories Limited, FreeGo pump Training Manual, Abbott Nutrition, Jul. 2013, 17 pages, Dublin, https://static-nocdn.abbottnutrition.com/cms/preview/abbottnutrition-2016.com/img/Abbott_Free_Go_Training_Manual_(pdf_1.77MB).pdf.
(Continued)

*Primary Examiner* — Nathan J Newhouse
*Assistant Examiner* — Lester L Vanterpool
(74) *Attorney, Agent, or Firm* — AVEK IP, LLC

(57) ABSTRACT

A bag for carrying a mobile feeding pump system having a feeding pump, a feeding supply, input tubing between the feeding pump and the feeding supply, and output tubing from the feeding pump. The bag includes a back panel, at least one strap, and first, second, and third compartments. The first compartment is generally adjacent the back panel and configured to hold the feeding supply. The second compartment is configured to hold the feeding pump. The third compartment is laterally adjacent the first compartment and is configured to hold a portion of the output tubing. A first passage is between the first and second compartments, and a second passage is between the first compartment and the third compartment. Each passage is configured to allow tubing to pass therethrough, has an open state and a closed state, and has a closure for selectively maintaining the passage at the closed state.

15 Claims, 7 Drawing Sheets

(56) References Cited

U.S. PATENT DOCUMENTS

| | | | | |
|---|---|---|---|---|
| 2009/0294499 | A1* | 12/2009 | Mckinney | B43L 1/00 224/153 |
| 2014/0061273 | A1* | 3/2014 | Bullivant | A45F 3/04 224/576 |
| 2014/0374450 | A1* | 12/2014 | Kruse | A45F 4/02 224/153 |
| 2015/0157113 | A1* | 6/2015 | Anelevitz | A45C 15/00 224/576 |
| 2015/0265352 | A1* | 9/2015 | Johnson | A61J 15/0026 224/676 |
| 2015/0366333 | A1* | 12/2015 | Zhijian | A45C 15/00 224/576 |

OTHER PUBLICATIONS

Amy Long Carrera, How to Use an Enteral Backpack, Flourish, Feb. 7, 2014, 4 pages, Shield Healthcare, http://www.shieldhealthcare.com/community/nutrition/2014/02/07/tube-feeding-how-to-use-an-enteral-backpack/.

Kangaroo Joey Mini & Super Mini Backpacks, Vitality Medical, Medtronic, 3 pages, https://www.vitalitymedical.com/kangaroo-joey-mini-super-mini-backpacks.html.

McKesson, Enternal Feeding Pump 500ml Capacity, May 11, 2022, 1 page, Amazon: https://www.amazon.com/Feeding-Backpack-Enteral-500ml-Capacity/dp/B08DDD3WBV.

ZEVEX Incorporated, EnteraLite Infinity Enteral Feeding Pump Operator's Manual, 2007, 58 pages, Salt Lake City, United States, https://www.sphp.com/assets/documents/cc/enteralite_infinity_pump-english.pdf.

* cited by examiner

CARRYING BAG FOR FEEDING PUMP

CROSS REFERENCE TO RELATED APPLICATIONS

This application claims the benefit of priority of U.S. Provisional Patent Application No. 63/490,476, filed Mar. 15, 2023, the entire disclosure of which is incorporated herein by reference.

FIELD OF THE DISCLOSURE

The present invention relates generally to the field of shoulder strap carrying bags for medical devices. More specifically, the invention relates to a backpack for carrying an enteral feeding apparatus, including but not limited to a feeding supply, a pump, and associated tubing.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

According to one embodiment, a bag for carrying a mobile feeding pump system having a feeding pump, feeding supply, intake tubing between the feeding pump and feeding supply, and output tubing from the feeding pump includes a back panel, at least one strap, a first compartment, a second compartment, and a third compartment. The first compartment is configured to hold the feeding supply and is generally adjacent the back panel between the back panel and the second compartment. The second compartment is configured to hold the feeding pump. The third compartment is laterally adjacent the first compartment and is configured to hold a coiled portion of the output tubing, and each compartment is independently accessible from an exterior of the bag. The bag includes a first passage between the first compartment and the second compartment, the passage having an open state and a closed state and being configured for the output tubing and the tubing between the feeding pump and the feeding supply to pass therethrough when the passage is at the open state. The bag also has a first closure for selectively maintaining the first passage at the closed state. A second passage having an open state and a closed state is between the first compartment and the third compartment and is configured for the output tubing to pass therethrough when the first compartment is at the open state. The bag further includes a second closure for selectively maintaining the second passage at the closed state.

According to another embodiment, a bag for carrying a mobile feeding pump system having a feeding pump, feeding supply, tubing between the feeding pump and feeding supply, and output tubing from the feeding pump includes a back panel, at least one strap, a first compartment, a second compartment, and a third compartment. Each of the three compartments is independently accessible from an exterior of the bag. The first compartment is generally adjacent the back panel, between the back panel and the second compartment, and is configured to hold the feeding supply. The second compartment is configured to hold the feeding pump, and is connected to the first compartment via a first passage. The first passage is configured for the output tubing and the tubing between the feeding pump and the feeding supply to selectively pass therethrough. The third compartment is laterally adjacent the first compartment and is configured to hold a coiled portion of the output tubing. The third compartment is connected to the first compartment via a second passage configured for the output tubing to selectively pass therethrough.

According to yet another embodiment, a bag for carrying a mobile feeding pump system having a feeding pump, feeding supply, intake tubing between the feeding pump and feeding supply, and output tubing from the feeding pump includes a back panel, at least one strap, a first compartment, a second compartment, and a third compartment, with each compartment being independently accessible from an exterior of the bag. The first compartment is generally adjacent the back panel and includes attachment means for selectively coupling the feeding supply to the back panel. The second compartment is longitudinally adjacent the first compartment and has a means for holding the mobile feeding pump. The third compartment has restraining means for holding a portion of the output tubing and is biased toward a closed state. The bag includes a first passage with open and closed states which is between the first compartment and the second compartment and is sized to allow at least the intake tubing to pass therethrough. There is a first closure means for selectively alternating the first passage between the open and closed states. The bag also includes a second passage having an open state and a closed state, with the second passage being sized to allow the output tubing to selectively pass therethrough, as well as a second closure means for selectively alternating the second passage between the open state and the closed state.

According to a further embodiment, a mobile feeding pump system includes a bag, a feeding pump, a feeding supply, input tubing between the feeding pump and the feeding supply, and output tubing from the feeding pump. The bag includes a back panel and at least one strap configured such that the back panel is against a user's back when the strap is worn by a user. The bag further includes a first compartment adjacent the back panel and a second compartment, with the first compartment being between the second compartment and the back panel. The bag also includes a third compartment laterally adjacent the first compartment, along with a first passage between the first compartment and the second compartment and a second passage between the first compartment and the third compartment. The feeding supply is located in the first compartment and the feeding pump is located in the second compartment. A portion of the input tubing passes through the first passage, while a portion of the output tubing also passes through the first passage. The output tubing is at least partially contained in the third compartment.

DETAILED DESCRIPTION

Figure 1:
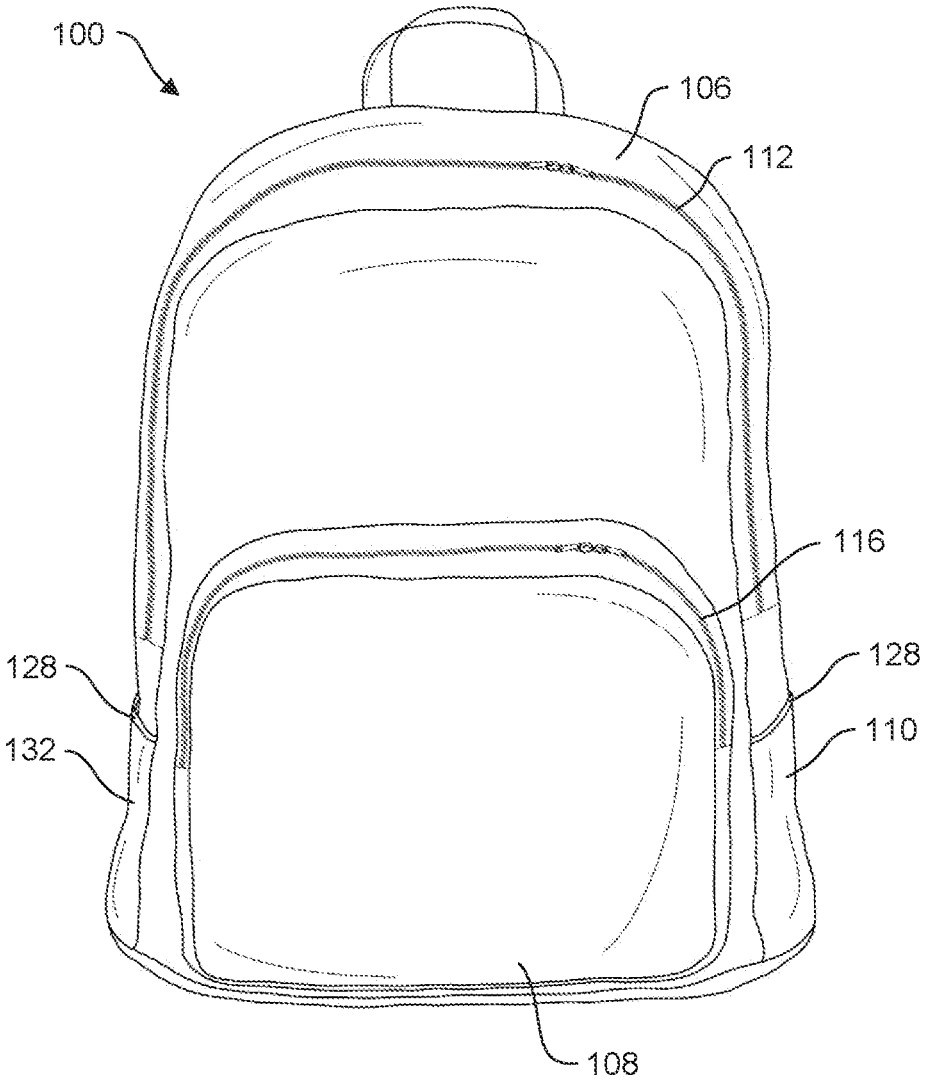
FIG. 1 is a front view of a bag for carrying a mobile feeding pump system.

Enteral feeding tube systems are known in the art and are commonly used by those who suffer from nutritional deficiencies, digestive problems, physical limitations, or other ailments which severely limit a person's ability to consume food. These feeding systems typically include a feeding pump, a feed bag or feeding supply, intake tubing between the feeding pump and the feeding supply, and output tubing from the feeding pump to the user or patient. When using the system at a patient's home or a medical facility, these systems may be erected using stationary or mobile stands which severely limit the patient's movement. These stands are neither convenient nor practical for users who require feeding when outside of these locations, such as at work or school. As such, many users find it beneficial to house the feeding pump system in a specialized carrying bag or backpack. This allows the user to access their food supply with relative ease regardless of location. Preferably, the appearance of the specialized backpack does not differ significantly from typical bags of this nature, while containing sufficient storage space to discreetly house the feeding system.

FIGS. 1 through 6 show an exemplary embodiment of a bag 100 for carrying a mobile feeding pump system 10, according to the present invention. The bag 100 includes at a back plate or back panel 102 and at least one strap 104. The bag 100 includes various compartments, such as a first compartment 106 configured to hold a feeding supply bag 12, a second compartment 108 configured to hold a feeding pump 14 and a portion of intake tubing 16 between the feeding pump 14 and the feeding supply 12, and a third compartment 110 configured to hold a coiled portion of an output feeding tube 18.

Figure 2:
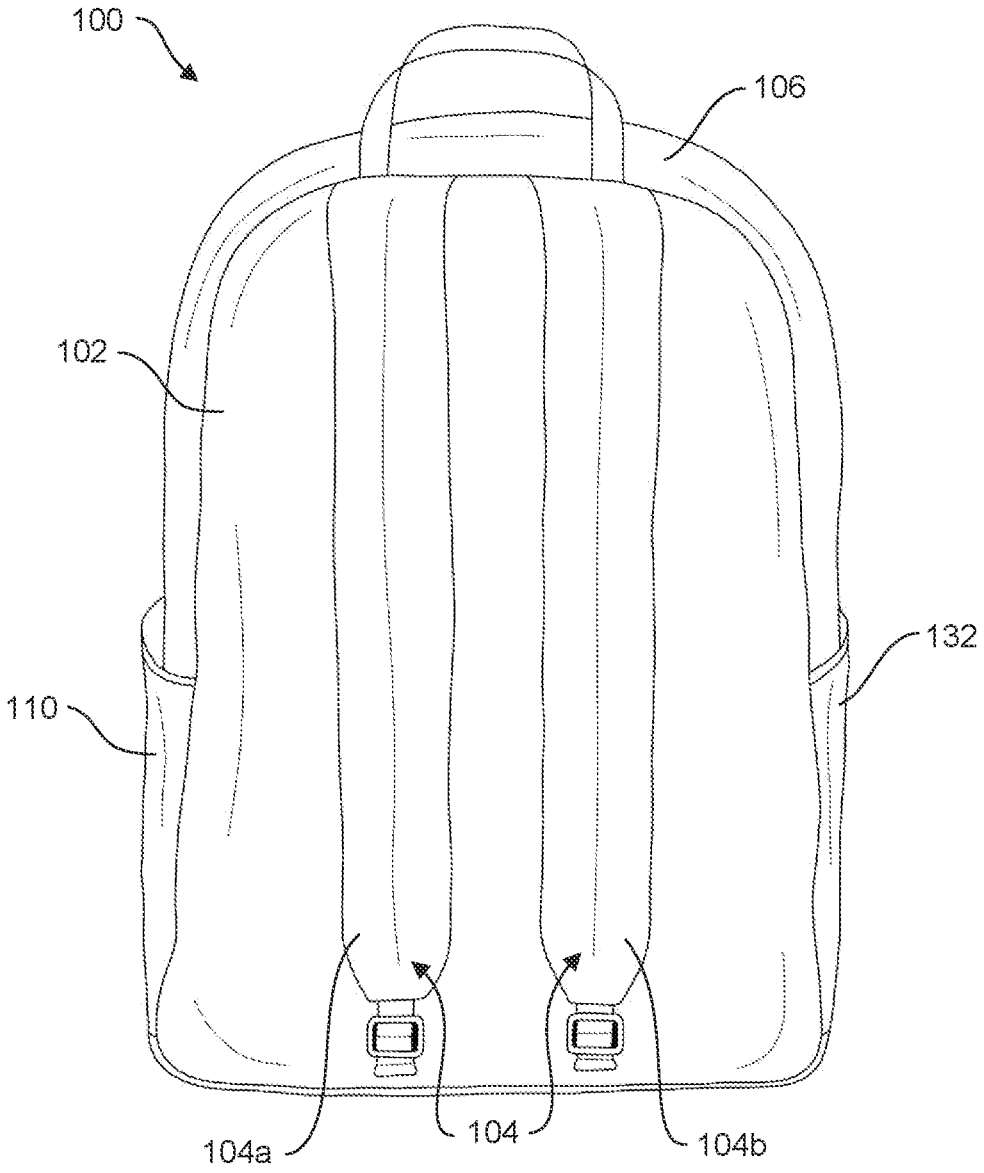
FIG. 2 is a rear view of the bag of FIG. 1.
Figure 3:
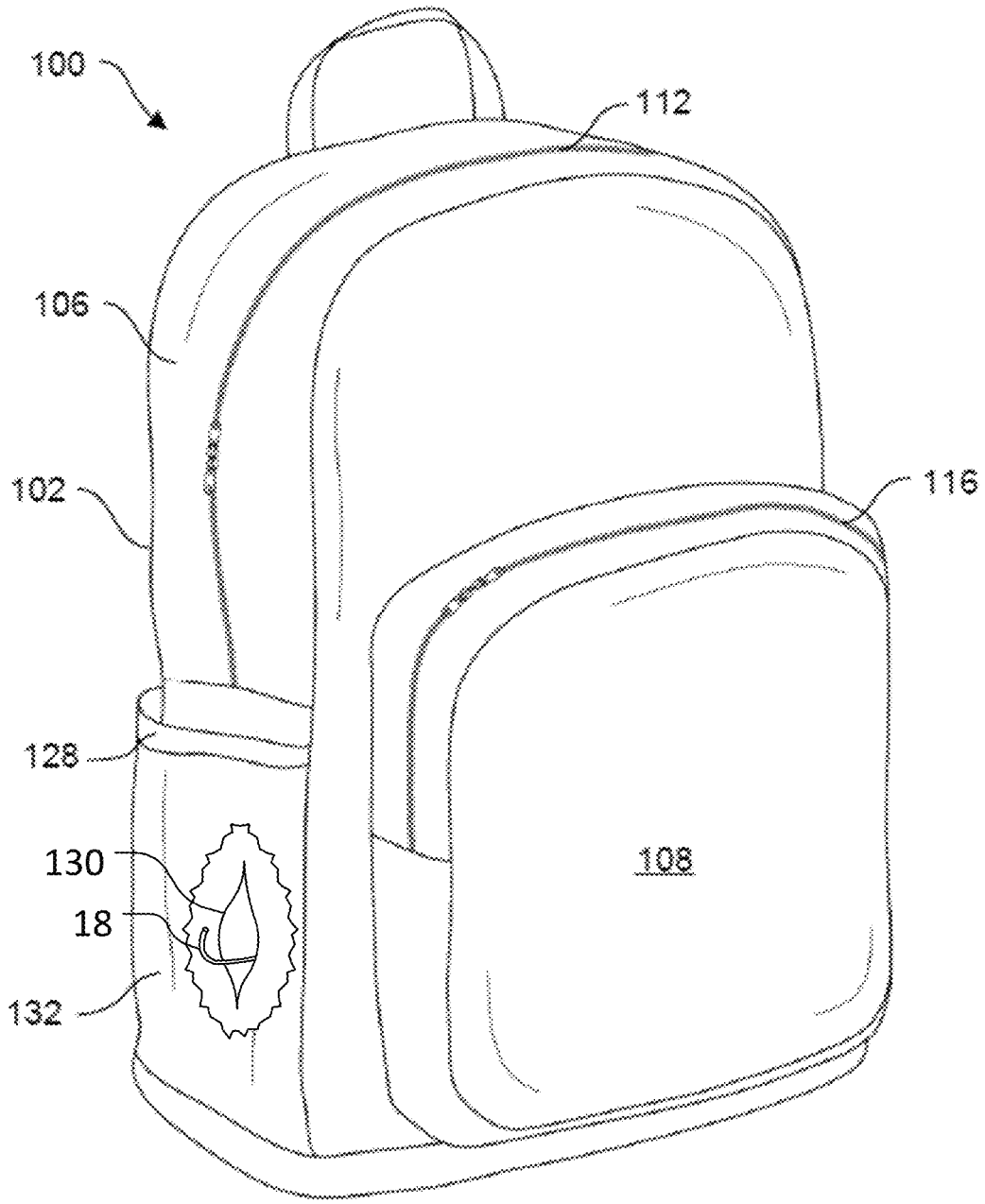
FIG. 3 is a front perspective view of the bag of FIG. 1.

The at least one strap 104 is configured such that the back panel 102 is in contact with the user's back when the bag is being worn. In some embodiments, such as the embodiment as seen in FIG. 2, the at least one strap may be a pair of straps 104*a* and 104*b* which are symmetrical about a vertical centerline of the back panel of the bag, allowing the user to place each strap over a shoulder.

In other embodiments, one or both of the straps 104*a* and 104*b* may be selectively detachable and/or have a variable length. This allows the user to better customize the fit and appearance of the bag, and enables the user to selectively alternate between a single-strap and multi-strap arrangement.

The first compartment 106 is generally adjacent the back panel 102 and is configured to hold the feeding supply 12. The first compartment is generally between the back panel 102 and the second compartment 108, and is typically the largest compartment of the bag. The first compartment 106 may include one or more closures 112 to limit access to the first compartment from an exterior of the bag. The closure(s) 112 may be in the form of zippers, such as in the illustrated and preferred embodiment. However, other embodiments may use different closure mechanisms including, but not limited to, buttons, drawstrings, snap closures, hook-and-loop fasteners, or other similar mechanisms now known or later developed.

The first compartment 106 is configured to hold at least the feed bag or feeding supply 12 forming part of the mobile feeding pump assembly. The compartment 106 preferably includes a restraining or attaching mechanism 114 for securing the feeding supply 12 in place. This restraint 114 keeps the feeding supply 12 in a controlled position, which reduces the risk of unforeseen spills or possible damage to the supply. Preferably, the restraint 114 is disposed on the interior surface of the back panel 102. As in the illustrated embodiment seen in FIG. 4, the restraint is most preferably located along a longitudinal centerline of the bag, such that the supply 12 is held in the central portion of the back panel 102.

Figure 4:
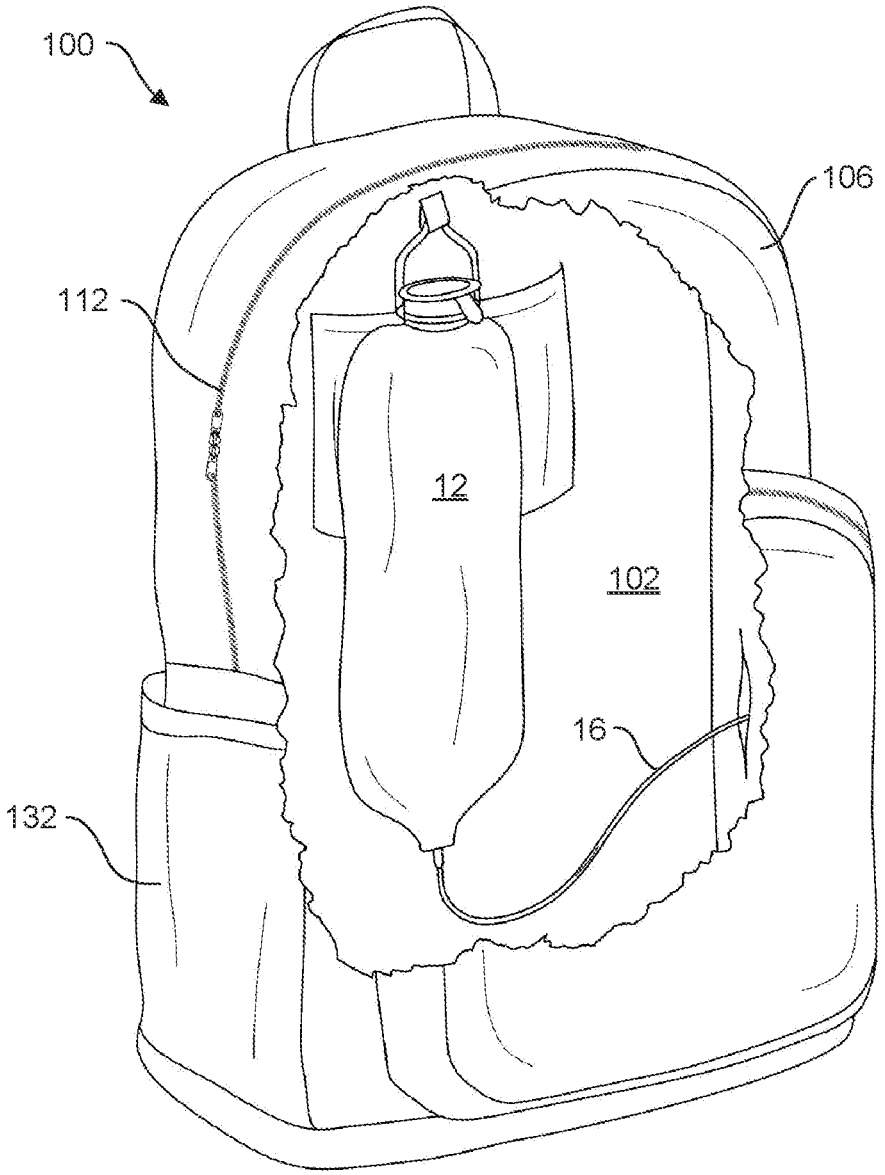
FIG. 4 is a breakaway perspective view of the bag of FIG. 1, showing a first compartment thereof.

The restraint 114 shown in FIG. 4 is a clip configured to pass through a complimentary slot on the feeding supply 12. Feeding supply bags 12 come in various shapes, and some may be only partially or even completely nonrigid, which may require different types of restraints. Therefore, in other embodiments the restraint 114 may be another mechanism including, but not limited to, a drawstring, a variable-length strap, hook-and-loop fasteners, magnets, etc. or any combination thereof.

The second compartment 108 is generally adjacent the first compartment 106 and is configured to hold the feeding pump 14. The second compartment 108 may be, as in the illustrated embodiment, of lesser volume than the first compartment 106, although in other embodiments the volume of the second compartment 108 may be substantially similar to that of the first compartment 106 or even greater than the volume of the first compartment 106. Similar to the first compartment 106, the second compartment 108 may include one or more closures 116 which are substantially similar to closures 112, and limit access to the second compartment 108 from an exterior of the bag.

Figure 5A:
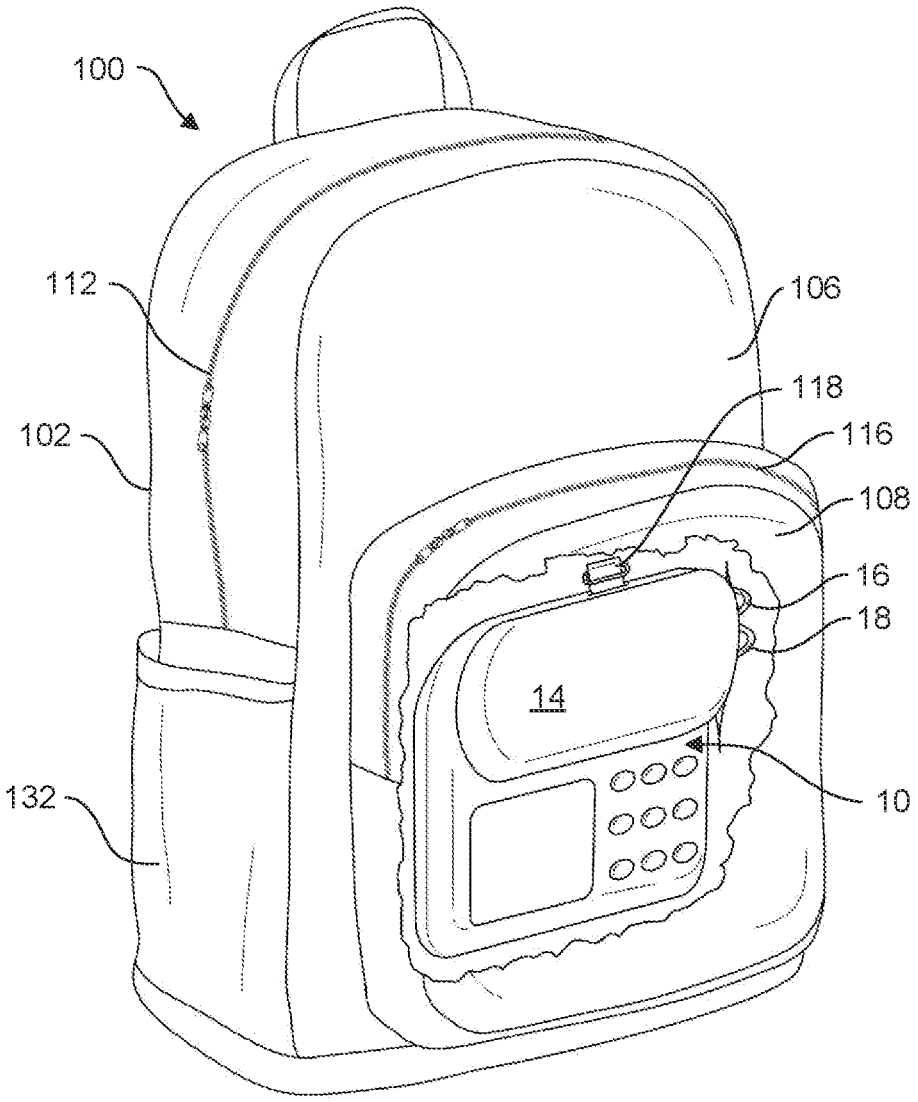
FIGS. 5A and 5B are an enlarged perspective view of the bag of FIG. 1, showing a second compartment thereof.
Figure 5B:
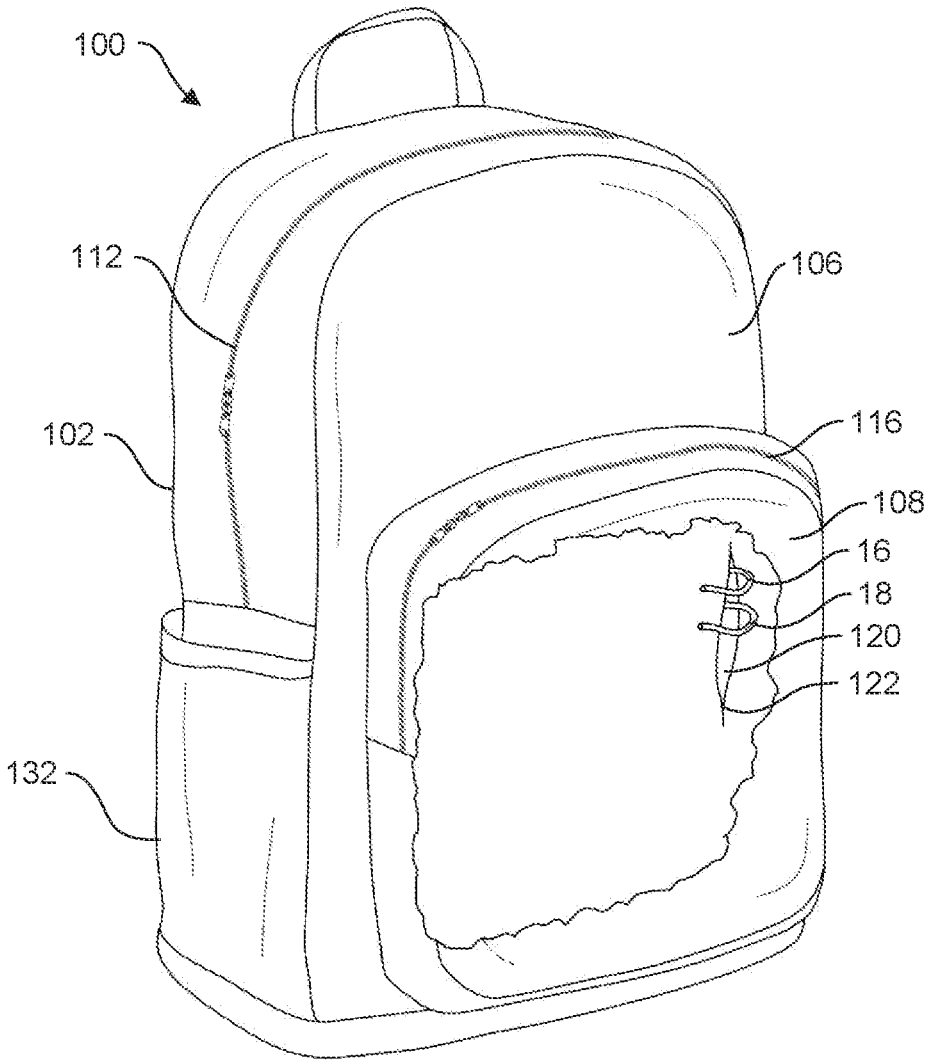
Figure 6:
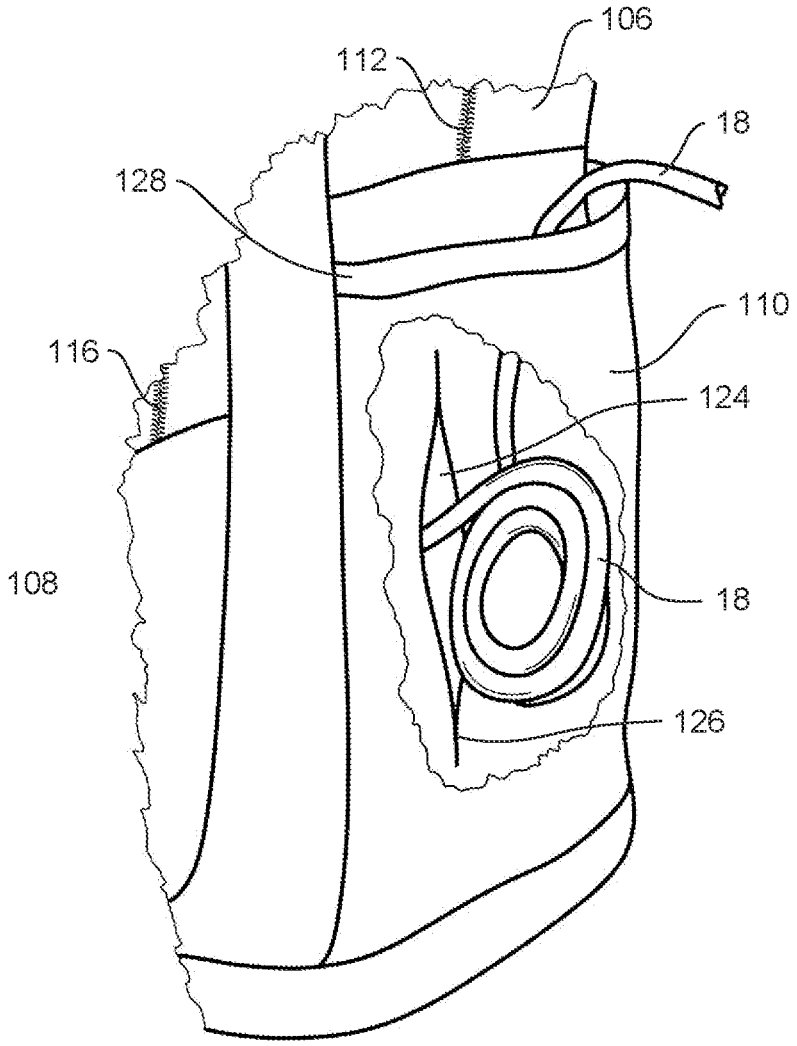
FIG. 6 is yet another enlarged perspective view of the bag of FIG. 1, showing a third compartment thereof.

The second compartment 108 seen in FIGS. 5A and 5B may include at least one interior pocket or sub-compartment sized to fit a feeding pump. In embodiments which do not include a dedicated pocket, the second compartment 108 may alternately include a restraining or securing mechanism 118 for holding the pump 14 in place. In still further embodiments, the second compartment itself may be sized such that the pump 14 occupies a substantial majority of the compartment's volume, thereby restricting the pump 14 from moving unnecessarily.

The bag 100 may be primarily fashioned from materials known to those in the art, such as nylon, canvas, polyester, cotton, or other suitable fabrics. While these materials are typically cost-effective and sufficiently strong, it may be advantageous for at least a portion of the bag to be fashioned from a transparent or translucent material which would allow for the user to see the interior of the bag. For example, the feeding pump 14 stored in the second compartment 108 may include a display or similar user interface which may provide relevant information about the pump, such as charge remaining or other system information. In some embodiments, at least a portion of the second compartment 108 may be fashioned from a transparent or translucent material which would allow the user to read information from the display without having to open the bag itself. Additionally, a transparent or translucent material still provides protection to the pump by fully enclosing it, as opposed to having a hole or gap in the second compartment to allow access to the pump display.

Between the first compartment 106 and the second compartment 108 is a first internal passage 120. This passage 120 has an open state and a closed state, and is configured to allow the intake tubing 16 between the pump 14 and the feeding supply 12 and the output tubing 18 from the feeding pump to pass selectively therethrough. The first passage 120, seen in FIG. 5B, may include one or more closures 122 for selectively maintaining the passage at the closed state, in order to prevent contents of the first compartment and the second compartment from mixing unintentionally. The closure(s) 122 may be in the form of zippers, such as in the illustrated embodiment, although those of skill in the art will appreciate that the closure may be any number of closure types now known or later developed. This includes, but is not limited to, hook-and-loop fasteners, snap closures, buttons, etc. or any inherent combination thereof. This may be beneficial if the user chooses to use the bag 100 without the mobile feeding pump system 10.

In addition to being fully in the open state or fully in the closed state, in some embodiments the first passage 120 may have a variable open state, wherein a portion of the passage 120 is open while the remainder remains closed. Likewise, for embodiments in which the open state is variable, it may be desirable for the passage 120 to extend for a full height of the second compartment 108, thereby maximizing the possible opening when in the open state. The user may then restrict the opening of the passage 120 accordingly using the closure 122, for example.

According to an embodiment, a third compartment 110 is laterally adjacent the first compartment 106 and is generally configured to hold a coiled portion of the output tubing 18. The third compartment 110 is preferably adjacent a lower portion of the first compartment 106, such as in the embodiment shown in FIGS. 1-6. However, the third compartment 110 may be adjacent other portions of the first compartment 106 in other embodiments.

When the mobile feeding pump system 10 is in use, the user or patient must connect to the system via the output tubing 18. Typically, this output tubing 18 is inserted into a user's stomach region, allowing food to flow from the feeding supply through the pump and to the user. To do this, the output tubing 18 must exit the first and second compartments 106 and 108, respectively and outside the interior of the bag 100 altogether. In the preferred embodiment, this is achieved via a second passage 124 between the first compartment 106 and the third compartment 110, allowing the output tubing to selectively pass through the passage 124 into the third compartment 110 and eventually to the user.

This second passage 124 is similar to the first passage 120 in having an open state and a closed state, with the output tubing passing therethrough when the second passage 124 is in the open state. In some embodiments the open state may be variable; in these (or additional) embodiments, the second passage 124 may extend along a full height of the third compartment 110, and a user may restrict the opening accordingly using a closure 126 which is substantially similar to closure 122 described previously.

The third compartment 110, like the first and second compartments 106 and 108, is independently accessible from an exterior of the bag, and may include one or more closures 128 which are substantially similar to closures 112 and 116 described above. Alternately, the third compartment 110 may include other closure types, for example an elastic band or similar material, which biases the third compartment 110 towards a closed state. This may be particularly beneficial to users when storing the output tubing 18 after feeding. Rather than opening the first or second compartments, when a user has finished the feeding process, they may coil the remaining output tubing 18 and place it in the third compartment 110 by pulling open the compartment closure 128 (which would be biased towards the closed state beforehand). The user then releases the elastic closure 128 and the compartment 110 is returned to the closed state, with the output tubing 18 being held in place and/or excluded from view.

In addition to the second passage 124, in some embodiments it may be preferable to have a third passage 130 located on the opposite side of the first compartment 106. The third passage 130 is functionally identical to the second passage 124 and includes similar features. This third passage 130 may be between the first compartment 106 and a fourth compartment 132, where the fourth compartment 132 is substantially similar to the third compartment 110 except for being disposed on the opposite side of the first compartment 106. In other embodiments, the passage 130 may be directly to the exterior of the bag 100. This third passage 130 provides users with the option to route the output tubing 18 through either of the second or third passages, such that the tubing would follow either the left or right side of their body. Users may choose a side/passage based on personal preference, or may have physical limitations which cause them to favor one side over another. In the event that the user does not choose to use the third passage, it may be left in the closed state.

In the illustrated and preferred embodiments, the output tubing 18 is routed from the pump 14 in the second compartment 108, through the first passage 120 into the first compartment 106, through a second passage 124 (or passage 130), and eventually to the exterior of the bag and to the user. However, in other embodiments, it may be advantageous for the second passage 124 (and/or the passage 130) to be between the second compartment 108 and the third or fourth compartments 110 and 132, respectively. Likewise, the third and/or fourth compartments 110 and 132 may be laterally adjacent the second compartment 108 rather than the first compartment 106. In this configuration, the first passage 120 may be smaller than other configurations, as it no longer needs to accommodate both the intake tubing 16 and the output tubing 18.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims.

What is claimed is:

1. A bag for carrying a mobile feeding pump system, the mobile feeding pump system having a feeding pump, a feeding supply, input tubing between the feeding pump and the feeding supply, and output tubing from the feeding pump, the bag comprising:

a back panel;

at least one strap configured such that the back panel is against a user's back when the strap is worn by the user;

a first compartment generally adjacent the back panel, the first compartment being configured to hold the feeding supply;

a second compartment, the first compartment being between the second compartment and the back panel, the second compartment being configured to hold the feeding pump;

a third compartment laterally adjacent the first compartment; the third compartment being configured to hold a coiled portion of the output tubing; the first, second, and third compartments being independently accessible from an exterior of the bag;

a first passage between the first compartment and the second compartment, the first passage having an open state and a closed state, the first passage being configured for the output tubing and the input tubing to pass therethrough only when the first passage is at the open state;

a first closure for selectively maintaining the first passage at the closed state;

a second passage between the first compartment and the third compartment, the second passage having an open state and a closed state, the second passage being configured for the output tubing to pass therethrough only when the second passage is at the open state;

a second closure for selectively maintaining the second passage at the closed state;

a fourth compartment laterally adjacent the first compartment and disposed on an opposite side to the third compartment, the fourth compartment being configured to hold a coiled portion of the output tubing and being independently accessible from an exterior of the bag; and a third passage between the first compartment and the fourth compartment, the third passage being configured for the output tubing to selectively pass therethrough.

2. The bag of claim 1, wherein the first and second closures are selected from the group consisting of: zippers, buttons, snap closures, drawstrings, and hook-and-loop fasteners.

3. The bag of claim 1, wherein a portion of the second compartment is fashioned from a non-opaque material such that an interior of the second compartment is visible from an exterior of the bag.

4. The bag of claim 1, wherein the third compartment is biased toward a closed state.

5. A bag for carrying a mobile feeding pump system, the mobile feeding pump system having a feeding pump, a feeding supply, input tubing between the feeding pump and the feeding supply, and output tubing from the feeding pump, the bag comprising:

a back panel;

at least one strap configured such that the back panel is against a user's back when the strap is worn by the user;

a first compartment generally adjacent the back panel, the first compartment being configured to hold the feeding supply;

a second compartment, the first compartment being between the second compartment and the back panel, the second compartment being configured to hold the feeding pump;

a third compartment laterally adjacent the first compartment; the third compartment being configured to hold a coiled portion of the output tubing; the first, second, and third compartments being independently accessible from an exterior of the bag;

a first passage between the first compartment and the second compartment, the first passage being configured for the output tubing and the input tubing to selectively pass therethrough;

a second passage between the first compartment and the third compartment, the second passage being configured for the output tubing to selectively pass therethrough;

a fourth compartment laterally adjacent the first compartment and disposed on an opposite side of the first compartment to the third compartment, the fourth compartment being configured to hold a coiled portion of the output tubing and being independently accessible from an exterior of the bag; and a third passage between the first compartment and the fourth compartment, the third passage being configured for the output tubing to selectively pass therethrough.

6. The bag of claim 5, further comprising a first closure for selectively alternating the first passage between an open state and a closed state and a second closure for selectively alternating the second passage between an open state and a closed state.

7. The bag of claim 6, wherein the open state of the first passage is variable and the open state of the second passage is variable.

8. The bag of claim 5, further comprising a first closure to limit access to the first compartment from the exterior of the bag and a second closure to limit access to the second compartment from the exterior of the bag.

9. The bag of claim 5, wherein the third compartment is biased toward a closed state.

10. The bag of claim 5, wherein the first compartment includes a restraint configured to hold the feeding supply; the restraint being disposed on the back panel along a longitudinal centerline of the bag.

11. The bag of claim 10, wherein the restraint is at least one item selected from the group consisting of: a clip, a snap closure, a drawstring, a variable-length strap, hook-and-loop fasteners, and magnets.

12. A bag for carrying a mobile feeding pump system, the mobile feeding pump system having a feeding pump, a feeding supply, intake tubing between the feeding pump and the feeding supply, and output tubing from the feeding pump, the bag comprising:

a back panel;

at least one strap configured such that the back panel is against a user's back when the strap is worn by the user;

a first compartment generally adjacent the back panel, the first compartment having attachment means for selectively coupling the feeding supply to the back panel;

a second compartment longitudinally adjacent the first compartment, the second compartment having means for holding the feeding pump;

a third compartment having restraining means for holding a portion of the output tubing;

the third compartment being biased toward a closed state; the first, second, and third compartments being independently accessible from an exterior of the bag;

a first passage between the first compartment and the second compartment, the first passage having an open state and a closed state, the first passage being sized to allow at least the intake tubing to pass therethrough when the first passage is at the open state;

a first closure means for selectively alternating the first passage between the open state and the closed state;

a second passage having an open state and a closed state, the second passage being sized to allow the output tubing to pass therethrough only when the second passage is at the open state;

a second closure means for selectively alternating the second passage between the open state and the closed state; and a third passage connected to the first compartment, the third passage having an open state and a closed state, the third passage being sized to allow the output tubing to pass therethrough only when the third passage is at the open state;

wherein the third compartment is laterally adjacent the first compartment, and the second passage is between the first compartment and the third compartment.

13. The bag of claim 12, wherein the third compartment is laterally adjacent the second compartment, and the second passage is between the second compartment and the third compartment.

14. The bag of claim 13, further comprising a third passage connected to the second compartment, the third passage having an open state and a closed state, the third passage being sized to allow the output tubing to pass therethrough only when the third passage is at the open state.

15. A mobile feeding pump system, comprising:

a bag comprising:

a back panel;

at least one strap configured such that the back panel is against a user's back when the strap is worn by a user;

a first compartment adjacent the back panel;

a second compartment, the first compartment being between the second compartment and the back panel;

a third compartment laterally adjacent the first compartment;

a first passage between the first compartment and the second compartment; and a second passage between the first compartment and the third compartment;

a feeding supply located in the first compartment;

a feeding pump located in the second compartment;

input tubing between the feeding pump and the feeding supply;

output tubing from the feeding pump; and a third passage connected to the first compartment, the third passage having an open state and a closed state, the third passage being sized to allow the output tubing to pass therethrough only when the third passage is at the open state;

wherein:

a portion of the input tubing passes through the first passage;

a portion of the output tubing passes through the first passage; and the output tubing is at least partially contained in the third compartment.

* * * * *